US006308845B1

(12) United States Patent
Sergent, IV

(10) Patent No.: US 6,308,845 B1
(45) Date of Patent: Oct. 30, 2001

(54) MODEL TRAIN COUPLER

(76) Inventor: B. Franklin Sergent, IV, 7620 Crestland Rd., Knoxville, TN (US) 37938

( * ) Notice: Subject to any disclaimer, the term of this patent is extended or adjusted under 35 U.S.C. 154(b) by 0 days.

(21) Appl. No.: 09/521,752

(22) Filed: Mar. 9, 2000

(51) Int. Cl.[7] ..... B61G 1/00
(52) U.S. Cl. ..... 213/75 TC; 213/75 D
(58) Field of Search ..... 213/75 R, 75 D, 213/75 TC, 100 R, 104

(56) References Cited

U.S. PATENT DOCUMENTS

| | | | | |
|---|---|---|---|---|
| 5,316,158 | * | 5/1994 | Dunham et al. | 213/75 TC |
| 5,509,546 | * | 4/1996 | Staat | 213/75 TC |
| 5,785,192 | | 7/1998 | Dunham et al. . | |
| 5,823,371 | * | 10/1998 | Riley et al. | 213/75 TC |
| 5,931,322 | * | 8/1999 | Storzek | 213/75 TC |

* cited by examiner

*Primary Examiner*—S. Joseph Moreno
*Assistant Examiner*—Robert J. McCarry, Jr.
(74) *Attorney, Agent, or Firm*—Pitts & Brittian, P.C.

(57) ABSTRACT

A model train coupler for coupling model train cars. The coupler includes a knuckle pivotally carried by a coupler head, and an internal locking mechanism for locking the orientation of the knuckle when closed. The knuckle defines an arcuate configuration such that engagement between two such knuckles securely couples the two cars on which they are mounted. The locking mechanism includes a locking arm carried by the knuckle and a locking ball. Both the locking arm and the locking ball are received within the coupler head. The distal and of the upper member defines a recess for receiving and limiting the rotation of the locking arm relative to the coupler head. The upper member recess defines a receptor for receiving the locking ball entirely above the locking arm. When the locking ball is encouraged into the upper member receptor, the knuckle is free to pivot. The lower member defines a corresponding lower member recess for partially receiving the locking ball when the knuckle is in a closed orientation. The ball is dimensioned and the lower member receptor is configured such that when the knuckle is in the closed orientation, without any outside influence, the ball is at rest within the lower member receptor and in close proximity to the leading edge of the locking arm, thereby preventing the knuckle from rotating relative to the coupler head. The various components of the coupler are fabricated from a non-ferrous material with the exception of the locking ball. The locking ball is magnetically attracted to a magnetic wand such that passage of the wand over the top of the coupler pulls the locking ball into the upper member receptor, thereby unlocking the knuckle.

12 Claims, 5 Drawing Sheets

MODEL TRAIN COUPLER

TECHNICAL FIELD

This invention relates to the field of model train couplers. More specifically, the present invention is related to a scale model of a coupler used for coupling equally scaled model train cars, the coupler being magnetically and mechanically actuated using magnetics.

BACKGROUND ART

It has been a well known hobby for many years for railroad enthusiasts around the world to build and operate model railroads. To accommodate this hobby, railroad equipment—including railroad cars, railroad track, buildings, and other properties—have been reduced to a scale version of the original. This allows the modeler to create his/her own setting for the particular train. The goal of each modeler is typically to create as lifelike a setting as possible. To this extent, it is desirable to have a coupler for coupling model railroad cars whereby the coupler is scaled to the same proportions as the cars, and whereby the coupler is close in physical appearance to a full scale coupler.

Due to the size and operation of a model train coupler, it is well known that achieving an accurate visual representation of a coupler is difficult. Specifically, it is difficult to construct a working scale model coupler that is also realistic in appearance.

Other model railroad couplers have been produced to couple model railroad cars. Typical of the art are those devices disclosed in the following U.S. Patents:

| U.S. Pat. No. | Inventor(s) | Issue Date |
|---|---|---|
| 5,785,192 | M. N. Dunham et al. | July 28, 1998 |
| 5,931,322 | D. Storzek | Aug. 3, 1999 |

The '192 device disclosed by Dunham et al., is typical of the prior art. The '192 device includes a knuckle pivotally carried by a coupler head, and a spring actuated locking mechanism. The knuckle is configured to engage the knuckle of another such device placed in an opposite orientation such that when they are so engaged and when each is locked, the respective cars to which they are mounted remain coupled one to the other. The locking mechanism includes a simulated air hose, which is essentially a magnetic arm which, when passed over a magnetic field, releases the knuckle, thereby allowing for the decoupling of the two model cars. However, at least for visual impact, it is not desirable to include the magnetic arm. Further, Dunham et al., note that known couplers are generally larger scale than the cars which they are designed to couple. As an example, they indicated that "HO scale is 1/85 scale", while "a typical HO coupler is approximately 1/70 scale." They concluded that "efforts have been made to make couplers smaller," but the presence of "extraneous structure has made this task difficult." Likewise, the extraneous structure taught by Dunham et al., impedes the task of achieving an accurately scaled coupler.

The '322 device disclosed by Storzek is formed from a pair of shanks disposed one on the other. Both shanks are rotatably mounted on a single pivot axis. One shank defines a knuckle at its distal end, and the other defines a lip. The shanks are each biased such that the knuckle and lip are biased toward each other. The knuckle and shank are configured such that another such device placed in an opposite orientation may be engaged with the device by pushing the two in a axial direction. In order to disengage the two devices, a specialized tool is wedged between the two knuckles and rotated clockwise. However, this type of mechanism fails to assimilate the functions of a full scale coupler. Specifically, the '322 device does not teach a knuckle pivotally mounted to a coupler head.

Therefore, it is an object of this invention to provide a scaled railroad car coupler for coupling equally scaled model train cars.

It is a further object of the present invention to provide such a coupler whereby the coupler includes a knuckle pivotally carried by a coupler head.

Another object of the present invention is to provide such a coupler including an internal locking mechanism for locking the orientation of the knuckle when closed.

Still yet another object of the present invention is to provide such a coupler whereby the locking mechanism is magnetically actuated.

DISCLOSURE OF THE INVENTION

Other objects and advantages will be accomplished by the present invention which provides a scaled railroad car coupler for coupling equally scaled model train cars. The coupler is configured to include a knuckle pivotally carried by a coupler head, and an internal locking mechanism for locking the orientation of the knuckle when closed, the locking mechanism being magnetically actuated.

The knuckle defines an arcuate configuration such that engagement between two such knuckles securely couples the two cars on which they are mounted. A pin is pivotally received within an opening defined in the proximal end of the knuckle. First and second ends of the pin are closely received within an opening defined at the distal end of each of the upper and lower members, respectively.

The locking mechanism includes a locking arm carried by the knuckle and a locking ball. Both the locking arm and the locking ball are received within the coupler head. The distal and of the upper member defines a recess for receiving and limiting the rotation of the locking arm relative to the coupler head. The recess defines an upper member receptor configured to receive the locking ball entirely above the locking arm. When the locking ball is encouraged into the upper member receptor, the knuckle is free to pivot. The lower member defines a lower member receptor for partially receiving the locking ball when the knuckle is in a closed orientation. The ball is dimensioned and the lower member receptor is configured such that when the knuckle is in the closed orientation, without any outside influence, the ball is at rest within the lower member receptor and in close proximity to the leading edge of the locking arm, thereby preventing the knuckle from rotating relative to the coupler head. In order to accomplish operation of the locking mechanism, the various components of the coupler are fabricated from a non-ferrous, or non-magnetizable material, with the exception of the locking ball. The locking ball is magnetically attracted to a magnetic wand such that passage of the wand over the top of the coupler pulls the locking ball into the upper member receptor, thereby unlocking the knuckle.

The proximal end of each of the upper and lower members defines a corresponding opening for receiving a train car post. Further, the distal end of each of the upper and lower members defines a corresponding slotted opening—opening at one end in the train car post opening—for receiving a spring. The spring provides a frictional engagement with the train car post for resisting pivotal movement between the coupler and the train car post.

In constructing the coupler, the pin is placed within the pin opening defined by the knuckle. In an alternative embodiment, the knuckle is fabricated with the pin embedded therein, or is integrally formed with the pin. The first end of the pin is then inserted into the pin opening defined by the upper member. The locking ball is then placed within the upper member receptor and the second end of the pin is inserted into the lower member pin opening. The upper and lower members are then secured to one another in a conventional manner. Any excess length of the pin is then removed in a conventional manner.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A model train coupler incorporating various features of the present invention is illustrated generally at 10 in the figures. The model train coupler, or coupler 10, is designed to provide a scaled railroad car coupler 10 for coupling equally scaled model train cars. The coupler 10 is configured to include a knuckle 46 pivotally carried by a coupler head 44, and an internal locking mechanism 52 for locking the orientation of the knuckle 46 when closed, the locking mechanism 52 being magnetically actuated.

Figure 1:
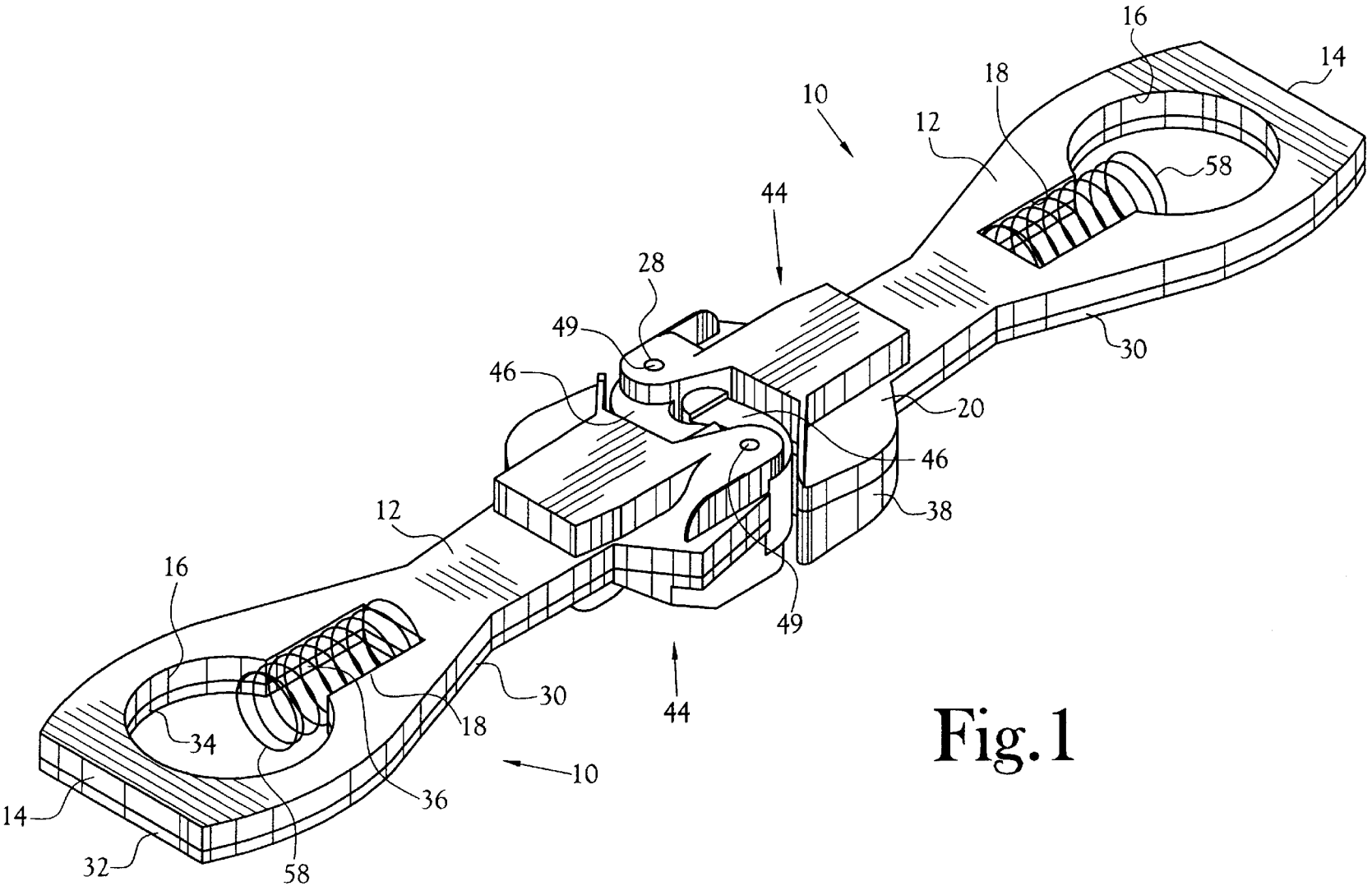
FIG. 1 is a perspective view of two model train couplers constructed in accordance with several features of the present invention showing the two couplers being interconnected.
Figure 2:
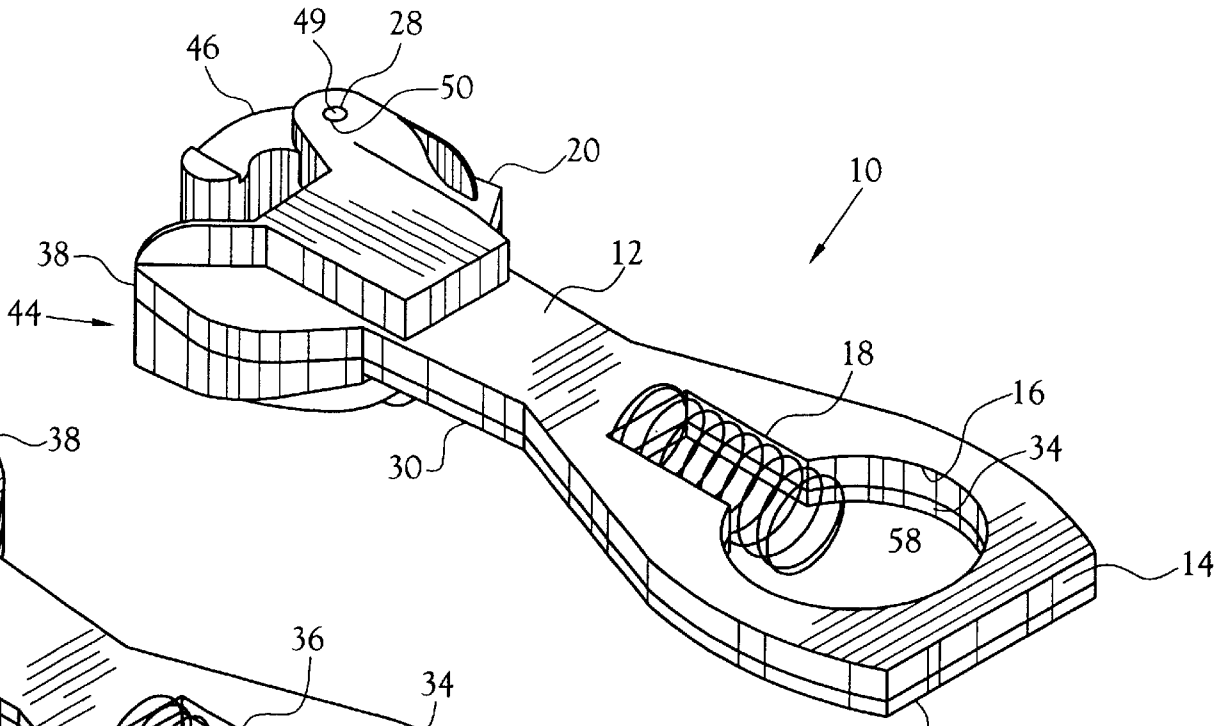
FIG. 2 illustrates a perspective view of the top of the model train coupler of FIG. 1.
Figure 3:
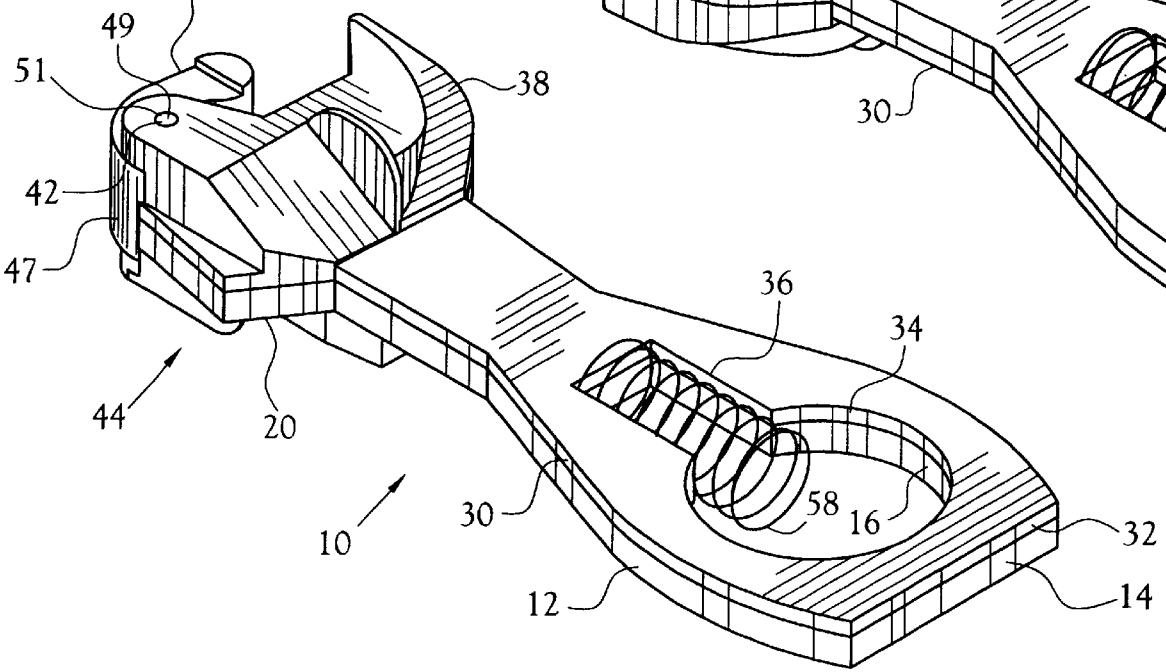
FIG. 3 illustrates a perspective view of the bottom of the model train coupler of FIG. 1.
Figure 4:
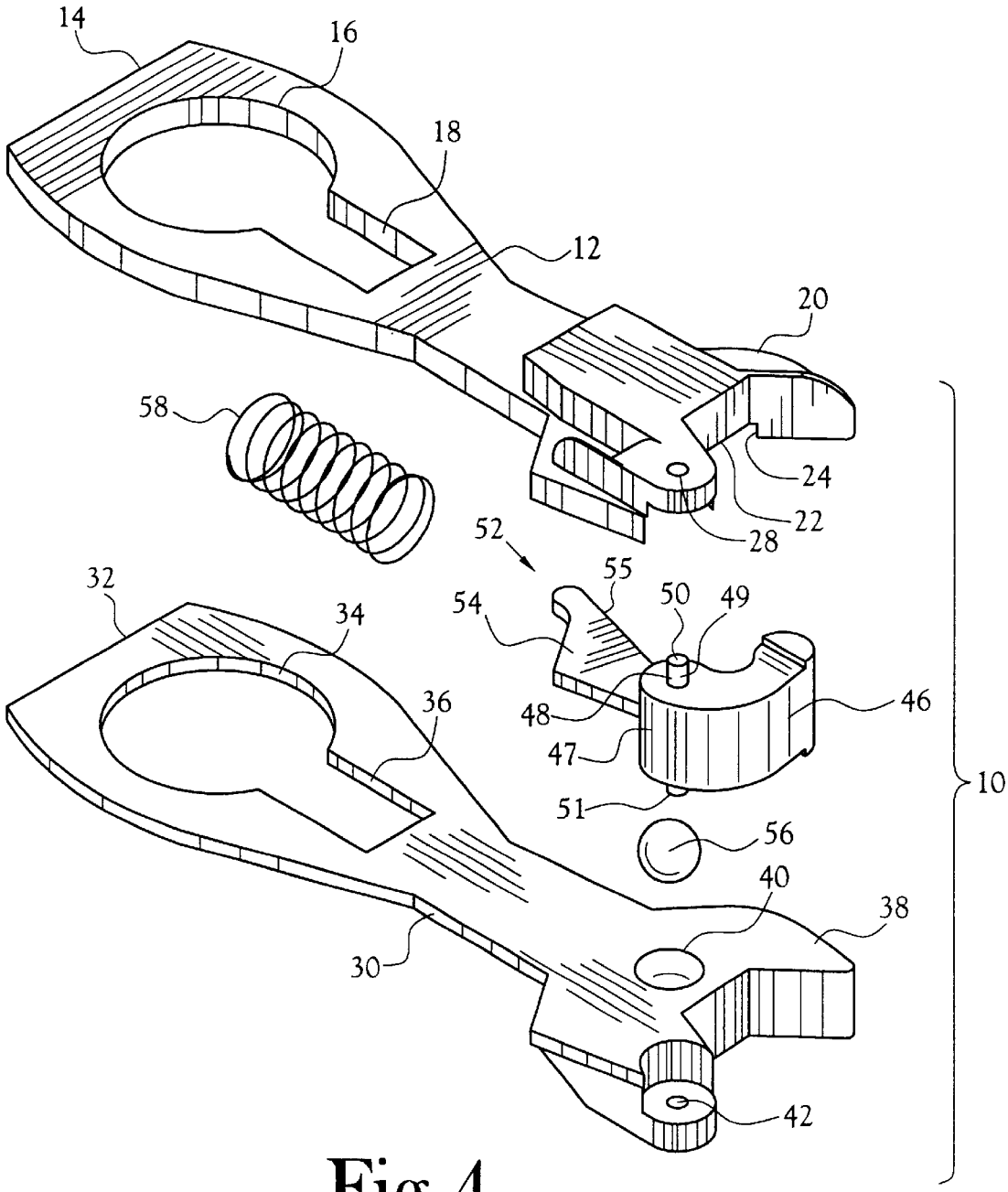
FIG. 4 illustrates an exploded view, in perspective, of the model train coupler of FIG. 1.

Illustrated in FIG. 1 is a perspective view of two couplers 10 of the present invention. The knuckle 46 of each coupler 10 is interconnected with each other coupler 10, both being in the locked position. Details of the coupler 10 are more clearly seen in FIGS. 2–4. FIGS. 2 and 3 illustrating a perspective view of the top and bottom, respectively, of the coupler 10, and FIG. 4 illustrating each of the components in exploded view. Referring specifically to FIG. 4, the coupler 10 includes an upper member 12 and a lower member 30. The distal end 20,38 of each of the upper and lower members 12,30 cooperate to define a coupler head 44 in which a knuckle 46 is rotatably mounted. A locking mechanism 52 is carried within the coupler head 44 for locking the knuckle 46 in a closed orientation.

The knuckle 46 defines an arcuate configuration such that engagement between two such knuckles 46 as illustrated in FIG. 1 securely couples the two cars on which they are mounted. A pin 49 is pivotally received within an opening 48 defined in the proximal end 47 of the knuckle 46. First and second ends 50,51 of the pin 49 are closely received within an opening 28,42 defined at the distal end 20,38 of each of the upper and lower members 12,30, respectively. Thus, the knuckle 46 is permitted to rotate about the pin 49 while the pin 49 remains stationary relative to the coupler head 44.

Figure 5A:
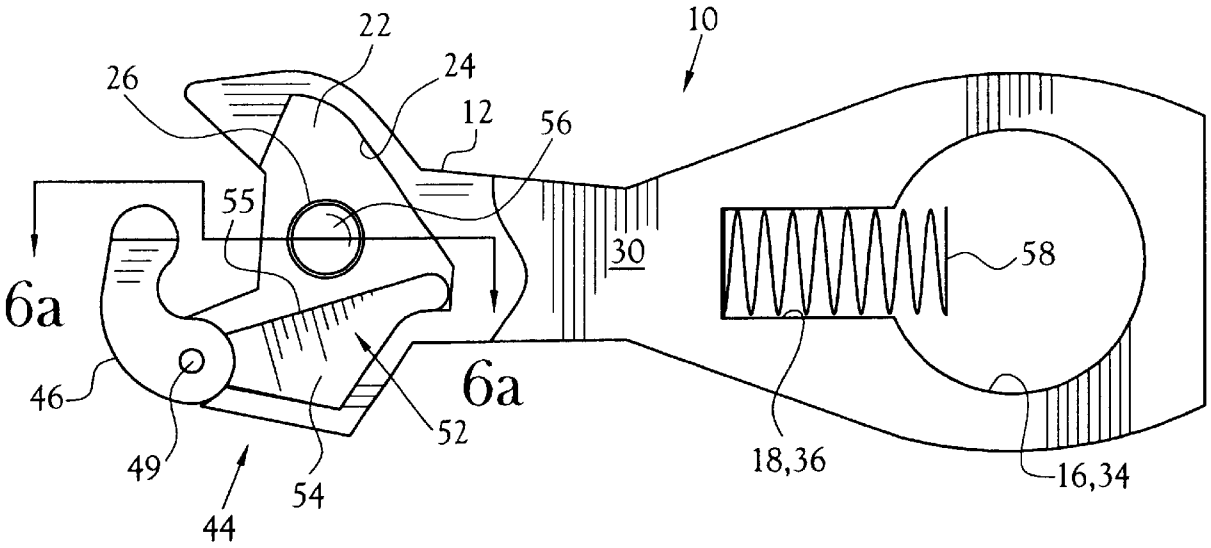
FIG. 5*a* is a bottom plan view of the model train coupler, shown partially in section, illustrating the locking ball in the lowered, locked position with the knuckle locked in a closed position.
Figure 5B:
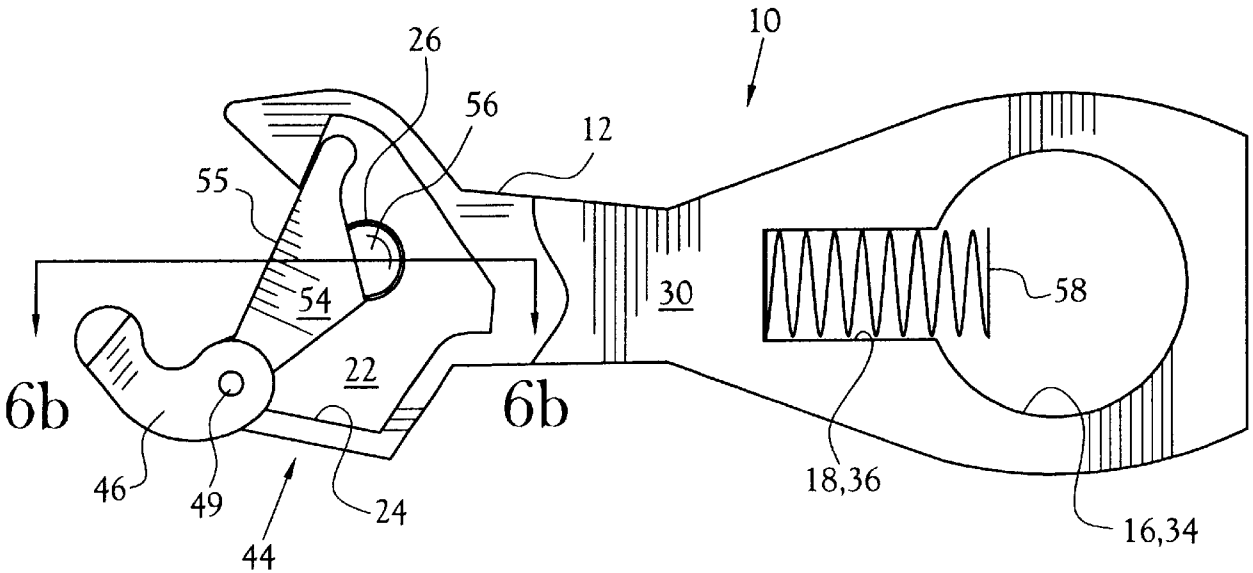
FIG. 5*b* is a bottom plan view of the model train coupler, shown partially in section, illustrating the locking ball in the raised, unlocked position with the knuckle locked in a fully open position.
Figure 6A:
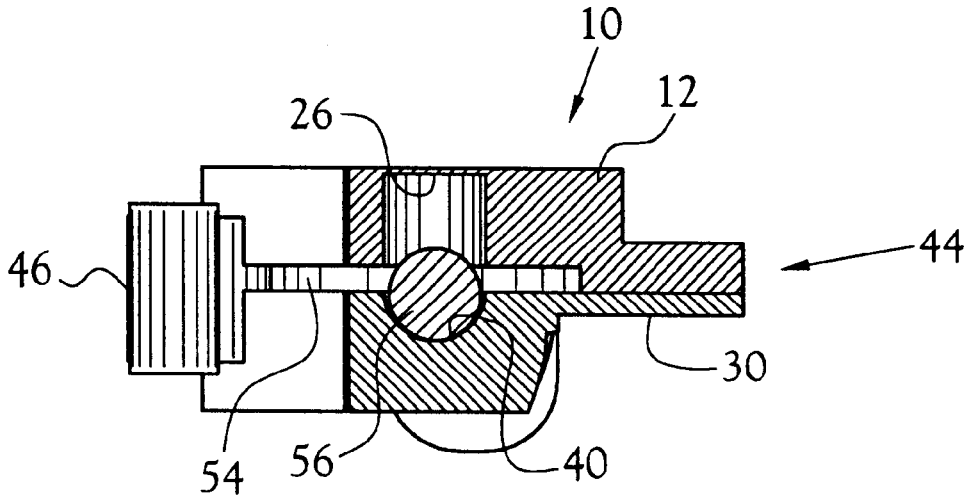
FIG. 6*a* is an elevation view, in section, taken along lines 6*a*—6*a* of FIG. 5*a*.

The locking mechanism 52 of the preferred embodiment includes a locking arm 54 carried by the knuckle 46 and a locking ball 56. Both the locking arm 54 and the locking ball 56 are received within the coupler head 44. The this extent, the distal end 20 of the upper member 12 defines a recess 22 for receiving the locking arm 54. The configuration of the recess 22 defines the limit of rotation of the locking arm 54, and thus the knuckle 46, relative to the coupler head 44. As seen more clearly in FIGS. 5*a*, 5*b*, 6*a* and 6*b*, the recess 22 is defined by a perimeter wall 24 configured to allow the knuckle 46 to rotate in one direction to a locked position (FIGS. 5*a* and 6*a*) and in another direction to an unlocked position (FIGS. 5*b* and 6*b*).

The lower member 30 defines a lower member receptor 40 for partially receiving the locking ball 56 when the knuckle 46 is in a closed orientation. The locking ball 56 is dimensioned and the lower member receptor 40 is configured such that when the knuckle 46 is in the closed orientation, without any outside influence, the locking ball 56 is at rest within the lower member receptor 40 and in close proximity to the leading edge 55 of the locking arm 54. Therefore, the locking arm 54 is prevented from rotating within the coupler head 44.

Figure 6B:
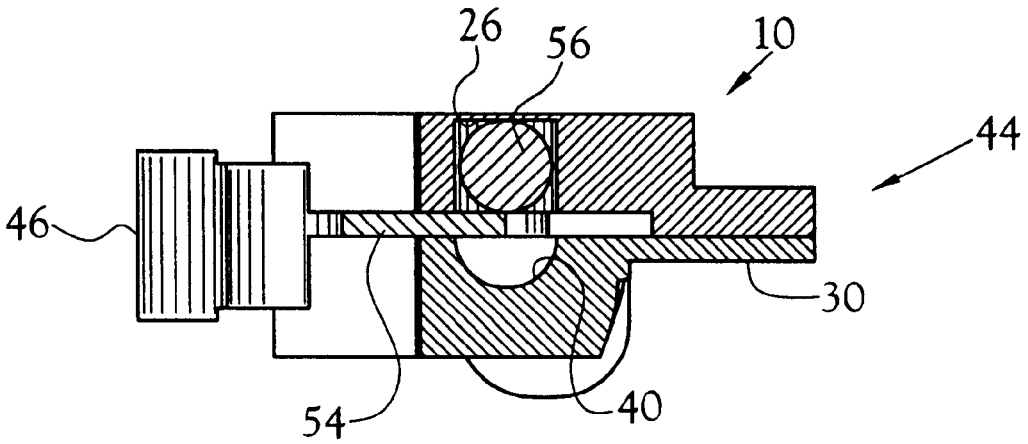
FIG. 6*b* is an elevation view, in section, taken along lines 6*b*—6*b* of FIG. 5*b*.

In order to unlock the knuckle 46, as best seen in FIG. 6*b*, the recess 22 defines a corresponding upper member receptor 26 configured to receive the locking ball 56 entirely above the locking arm 54. Thus, when the locking ball 56 is encouraged into the upper member receptor 26, the locking arm 54, and again the knuckle 46, is free to pivot. Once the knuckle 46 is in the open orientation, the locking ball 56 is released such that when the knuckle 46 is reoriented to the closed position, the locking ball 56 returns to a resting position in the lower member receptor 40.

In order to accomplish operation of the locking mechanism 52, the various components of the coupler 10 are fabricated from a non-ferrous, or non-magnetizable material, with the exception of the locking ball 56. The locking ball 56 is magnetically attracted to a magnetic wand (not shown) such that passage of the wand over the top of the coupler 10 pulls the locking ball 56 into the upper member receptor 26, thereby unlocking the knuckle 46. Although described and illustrated as a ball, it will be understood that the locking ball 56 may be replaced with a locking device of any geometric configuration configured to slide within the upper and lower member receptors 26,40, and to be completely received within the upper member receptor 26 and above the locking arm 54.

The proximal end 14,32 of each of the upper and lower members 12,30 defines a corresponding opening 16,34 for receiving a train car post (not shown). Further, each of the upper and lower members 12,30 defines a corresponding slotted opening 18,36—opening at one end in the train car post opening 16,34—for receiving a spring 58. The spring 58 provides a frictional engagement with the train car post for resisting pivotal movement between the coupler 10 and the train car post.

In constructing the coupler 10, the pin 49 is placed within the pin opening 48 defined by the knuckle 46. In an alternative embodiment, the knuckle 46 is fabricated with the pin 49 embedded therein, or is integrally formed with the pin 49. The first end 50 of the pin 49 is then inserted into the pin opening 28 defined by the upper member 12, with the locking arm 54 being disposed in the recess 22. The locking ball 56 is then placed within the upper member receptor 26 and the second end 51 of the pin 49 is inserted into the lower member pin opening 42. The upper and lower members 12,30 are then secured to one another such as by gluing. It will be understood that the pin 49 may alternately be inserted into the lower member pin opening 42 first, or in any other manner foreseen to accomplish the same result. Typically, the pin 49 defines a length longer than that required to extend entirely through each of the upper and lower member pin openings 28,42 and the knuckle pin opening 48. Therefore, the excess length is removed in a conventional fashion, such as by filing, after the upper and lower members 12,30 have been secured to one another.

From the foregoing description, it will be recognized by those skilled in the art that a model train coupler offering advantages over the prior art has been provided. Specifically, the coupler provides a scaled railroad car coupler for coupling equally scaled model train cars. The coupler is configured to include a knuckle pivotally carried by a coupler head, and an internal locking mechanism for locking the orientation of the knuckle when closed, the locking mechanism being magnetically actuated.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. A model train coupler for coupling two scale model railroad cars, said model train coupler comprising:

an upper member defining a proximal end and a distal end;

a lower member defining a proximal end and a distal end, said lower member being secured to said upper member, said upper member distal end and said lower member distal end cooperating to define a coupler head;

a knuckle pivotally carried by said coupler head; and a locking mechanism carried entirely within said coupler head for substantially preventing rotation of said knuckle when said knuckle is in a closed orientation.

2. The model train coupler of claim 1 wherein said locking mechanism is magnetically actuated.

3. The model train coupler of claim 2 wherein said locking mechanism includes a locking arm carried by said knuckle and a locking ball, said distal and of said upper member defining a recess for receiving and limiting rotation of said locking arm, said recess defining an upper member receptor configured to receive said locking ball entirely above said locking arm to allow said knuckle to freely rotate, said lower member defining a corresponding lower member receptor for partially receiving said locking ball when said knuckle is in said closed orientation.

4. The model train coupler of claim 3 wherein each of said upper member, said lower member, said knuckle and said locking arm are fabricated from a non-ferrous material, and wherein said locking ball is fabricated from a ferrous material whereby said locking ball is drawn into said upper member receptor when a magnetic source is placed in close proximity to said upper member of said coupler.

5. The model train coupler of claim 1 wherein said upper member proximal end and said lower member proximal end each defines a corresponding opening for receiving a conventional train car post, said upper member proximal end and said lower member proximal end each further defining a corresponding slotted opening, opening at one end in said train car post opening, said model train coupler further comprising a spring configured to be received within said slotted opening to provide a frictional engagement with the train car post for resisting pivotal movement between said coupler and the train car post.

6. A kit for assembling a model train coupler, said model train car coupler for coupling two scale model railroad cars, said kit comprising:

an upper member defining a proximal end and a distal end;

a lower member defining a proximal end and a distal end, said lower member being securable to said upper member, said upper member distal end and said lower member distal end cooperating to define a coupler head;

a knuckle pivotally carried by said coupler head; and a locking mechanism carried entirely within said coupler head for substantially preventing rotation of said knuckle when said knuckle is in a closed orientation.

7. The kit of claim 6 wherein said locking mechanism is magnetically actuated.

8. The kit of claim 7 wherein said locking mechanism includes a locking arm carried by said knuckle and a locking ball, said distal and of said upper member defining a recess for receiving and limiting rotation of said locking arm, said recess defining an upper member receptor configured to receive said locking ball entirely above said locking arm to allow said knuckle to freely rotate, said lower member defining a corresponding lower member receptor for partially receiving said locking ball when said knuckle is in said closed orientation.

9. The kit of claim 8 wherein each of said upper member, said lower member, said knuckle and said locking arm are fabricated from a non-ferrous material, and wherein said locking ball is fabricated from a ferrous material whereby said locking ball is drawn into said upper member receptor when a magnetic source is placed in close proximity to said upper member of said coupler.

10. The kit of claim 6 wherein said upper member proximal end and said lower member proximal end each defines a corresponding opening for receiving a conventional train car post, said upper member proximal end and said lower member proximal end each further defining a corresponding slotted opening, opening at one end in said train car post opening, said model train coupler further comprising a spring configured to be received within said slotted opening to provide a frictional engagement with the train car post for resisting pivotal movement between said coupler and the train car post.

11. A method for assembling a model train coupler kit, said model train car coupler for coupling two scale model railroad cars, the model train coupler kit including an upper member defining a proximal end and a distal end, a lower member defining a proximal end and a distal end, the upper member distal end and the lower member distal end cooperating to define a coupler head, a knuckle pivotally carried by the coupler head, and a locking mechanism carried entirely within the coupler head for substantially preventing rotation of the knuckle when the knuckle is in a closed orientation, said method comprising the steps of:

pivotally mounting the knuckle to one of the lower member and the upper member;

disposing the locking mechanism within the coupler head;

pivotally mounting the knuckle to a remaining of the lower member and the upper member;

securing the lower member to the upper member, whereby the locking mechanism is received within the coupler head and whereby the knuckle is locked when in a closed orientation.

12. The method of claim 11 wherein the locking mechanism includes a locking arm carried by the knuckle and a locking ball, the distal and of said upper member defining a recess for receiving and limiting rotation of the locking arm, the recess defining an upper member receptor configured to receive the locking ball entirely above the locking arm to allow the knuckle to freely rotate, the lower member defining a corresponding lower member receptor for partially receiving the locking ball when the knuckle is in the closed orientation, and wherein said step of disposing the locking mechanism within the coupler head includes the steps of:

positioning the locking arm within the recess; and disposing the locking ball within the lower member receptor.

* * * * *